US010954900B2

(12) United States Patent
Martin

(10) Patent No.: US 10,954,900 B2
(45) Date of Patent: Mar. 23, 2021

(54) ELASTIC CONNECTING SUPPORT

(71) Applicant: Andreas Stihl AG & Co. KG, Waiblingen (DE)

(72) Inventor: Daniel Martin, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 16/541,882

(22) Filed: Aug. 15, 2019

(65) Prior Publication Data

US 2020/0056569 A1 Feb. 20, 2020

(30) Foreign Application Priority Data

Aug. 15, 2018 (EP) ..... 18189125

(51) Int. Cl.
*F02M 35/10* (2006.01)
*F02B 75/02* (2006.01)

(52) U.S. Cl.
CPC ..... *F02M 35/10078* (2013.01); *F02B 75/02* (2013.01); *F02M 35/1017* (2013.01); *F02M 35/10137* (2013.01); *F02B 2075/025* (2013.01)

(58) Field of Classification Search
CPC ..... F02M 35/10078; F02M 35/10137; F02M 35/1017; F02B 75/02; F02B 2075/025
USPC ..... 123/184.21
See application file for complete search history.

(56) References Cited

U.S. PATENT DOCUMENTS

| | | | |
|---|---|---|---|
| 5,231,956 | A | 8/1993 | Lux et al. |
| 5,474,039 | A | 12/1995 | Doeragrip |
| 6,868,813 | B2 | 3/2005 | Zimmermann et al. |
| 8,215,278 | B2 | 7/2012 | Kummermehr et al. |
| 8,225,755 | B2 | 7/2012 | Martinsson et al. |
| 8,967,099 | B2 | 3/2015 | Grether et al. |
| 9,175,598 | B2 | 11/2015 | Geyer et al. |
| 9,464,606 | B2 | 10/2016 | Friedrich et al. |
| 9,988,970 | B2 | 6/2018 | Ohsawa et al. |
| 2003/0217740 | A1* | 11/2003 | Zimmermann .. F02M 35/10301 123/590 |

(Continued)

FOREIGN PATENT DOCUMENTS

| | | | |
|---|---|---|---|
| DE | 102004037187 | A1 | 3/2005 |
| DE | 102007037009 | A1 | 3/2008 |

(Continued)

*Primary Examiner* — Joseph J Dallo
*Assistant Examiner* — Yi-Kai Wang
(74) *Attorney, Agent, or Firm* — Walter Ottesen, P.A.

(57) ABSTRACT

An elastic connecting support for arrangement between a combustion engine and an air filter of a handheld work apparatus is disclosed. The connecting support has a first channel for largely fuel-free air and a second channel for a fuel/air mixture. The connecting support is realized as a single piece, and has, on a first side, an engine connecting flange, at which the first and second channel end, for connection to the combustion engine. The first channel has a first peripheral wall and the second channel has a second peripheral wall. The first peripheral wall and the second peripheral wall are arranged at a distance in relation to each other in a longitudinal section of the connecting support. The channels extend from the first side to a second side of the connecting support. On the second side, the first channel and the second channel end at a common connecting flange.

14 Claims, 5 Drawing Sheets

(56) References Cited

U.S. PATENT DOCUMENTS

| | | | | |
|---|---|---|---|---|
| 2005/0045138 | A1 | 3/2005 | Schmidt et al. | |
| 2009/0188461 | A1* | 7/2009 | Kummermehr .. | F02M 35/10137 123/184.52 |
| 2009/0314243 | A1* | 12/2009 | Schmidt ..... | F02M 35/10085 123/184.61 |
| 2015/0027396 | A1* | 1/2015 | Friedrich ..... | F02M 35/10301 123/184.21 |
| 2016/0153346 | A1* | 6/2016 | Ohsawa ..... | F02B 25/20 123/586 |

FOREIGN PATENT DOCUMENTS

| | | | |
|---|---|---|---|
| DE | 102008006681 | A1 | 8/2009 |
| DE | 102010054840 | A1 | 6/2012 |
| DE | 102013012510 | A1 | 1/2015 |
| EP | 3026250 | A1 | 6/2016 |
| JP | 2002242679 | A | 8/2002 |

* cited by examiner

ELASTIC CONNECTING SUPPORT

CROSS REFERENCE TO RELATED APPLICATION

This application claims priority of European patent application no. 18 189 125.0, filed Aug. 15, 2018, the entire content of which is incorporated herein by reference.

FIELD OF THE INVENTION

The disclosure relates to an elastic connecting support for arrangement between a combustion engine and an air filter of a handheld work apparatus.

BACKGROUND OF THE INVENTION

US 2005/0045138 discloses a connecting support, having a first channel for largely fuel-free air, and having a second channel for fuel/air mixture, which is arranged between a combustion engine and an air filter. The channels extend from a first side of the connecting support that faces toward the combustion engine to a second side of the connecting support that is assigned to the air filter. The two channels are routed, as separate channels, out from an engine connecting flange. Consequently, the elasticity of the connecting support is sufficiently great, when the connecting support is in the installed state, to permit relative movement between the combustion motor and the air filter, without thereby incurring damage. The two channels must be connected individually, on the second side of the connecting support, to the respective components of the handheld work apparatus to which the connecting support is to be connected.

SUMMARY OF THE INVENTION

It is an object of the invention to provide a connecting support in such a manner that it is possible for the connecting support to be easily connected on its second side, which is assigned to the air filter, with, at the same time, good elasticity of the connecting support.

This object can, for example, be achieved by an elastic connecting support for arrangement between a combustion engine and an air filter of a handheld work apparatus. The elastic connecting support includes: a first channel for largely fuel-free air; a second channel for a fuel/air mixture; the elastic connecting support being realized as a single piece and having a first side and a second side; an engine connecting flange disposed at the first side for connection to the combustion engine; the first channel and the second channel ending at the engine connecting flange; the first channel having a first peripheral wall; the second channel having a second peripheral wall; the first peripheral wall and the second peripheral wall being arranged at a distance (v, h2) in relation to each other in a longitudinal section of the elastic connecting support; the first channel and the second channel extending from the first side to the second side of the elastic connecting support; a common connecting flange disposed at the second side; and, the first channel and the second channel ending at the common connecting flange.

It is a further object of the invention to provide a handheld work apparatus, having a connecting support, in such a manner that it is possible for the connecting support to be easily connected, via its second side, assigned to the air filter, to a component of the work apparatus, with, at the same time, good elasticity of the connecting support.

This object can, for example, be achieved by a handheld work apparatus having: a combustion engine; a carburetor; an elastic connecting support having a first channel for largely fuel-free air and a second channel for a fuel/air mixture; the elastic connecting support being realized as a single piece and having a first side and a second side; the elastic connecting support having an engine connecting flange disposed at the first side for connection to the combustion engine; the first channel and the second channel ending at the engine connecting flange; the first channel having a first peripheral wall; the second channel having a second peripheral wall; the first peripheral wall and the second peripheral wall being arranged at a distance (v, h2) in relation to each other in a longitudinal section of the elastic connecting support; the first channel and the second channel extending from the first side to the second side of the elastic connecting support; the elastic connecting support having a common connecting flange disposed at the second side; the first channel and the second channel ending at the common connecting flange; and, the elastic connecting support being arranged between the combustion engine and the carburetor.

The disclosure provides that the first peripheral wall and the second peripheral wall are arranged at a distance from each other in a longitudinal section of the connecting support, and that, on the second side, the first channel and the second channel end at a common connecting flange. When the connecting support is in the installed state, the first side faces toward the combustion engine and the second side faces toward the air filter. Further components such as, for example, a carburetor, may be arranged in this case between the connecting support and the air filter. The first side is also referred to as the engine side, and the second side is also referred to as the air filter side.

Since, on the second side, the first and the second channel end at a common connecting flange, the two channels of the connecting support can easily be connected to a handheld work apparatus. The two channels do not have to be connected individually to the handheld work apparatus, but can be connected easily and rapidly to the work apparatus by connection of the common connecting flange. Although, both on the first side and on the second side, the channels end in a single flange in each case, the elasticity of the connecting support is so great, owing to the distance of the channels in the longitudinal section, that, when the connecting support is in the installed state, a relative movement is possible between the combustion engine and the air filter of the handheld work apparatus without the connecting support being damaged thereby.

Owing to the common connecting flange for the two channels on the air filter side, only a single connection, namely the connection between the common connecting flange and a component of the handheld work apparatus, need be sealed for tight connection of the two channels on the air filter side. The component of the work apparatus may be, for example, an air filter, an intermediate component or a carburetor.

Expediently, a through opening can be realized between the first peripheral wall and the second peripheral wall, in the longitudinal section of the connecting support. This results in a high degree of elasticity of the connecting support.

Advantageously, the longitudinal section in which the peripheral walls of the channels are at a distance from each other can extend as far as the engine connecting flange. The two channels are connected to each other via the engine connecting flange.

In an embodiment, the first channel has an expansion fold running in the peripheral direction of the first channel. The connecting support, when arranged between a combustion engine and an air filter of a handheld work apparatus, can consequently permit comparatively large relative movements between the air filter and the combustion engine and, at the same time, be tightly connected to the air filter and the combustion engine. The expansion fold increases the elasticity of the connecting support in a direction parallel to the connecting surface of the engine connecting flange. A change in the absolute length of the first channel, measured in a direction perpendicular to a connecting surface of the engine connecting support, is rendered possible by the expansion fold.

Expediently, of the two channels, only the first channel has an expansion fold running in the peripheral direction. The second channel is provided to supply air/fuel mixture. If there is an expansion fold arranged in the second channel, fuel can collect in this expansion fold and pass from there in an uncontrolled manner into the combustion engine. This is prevented, advantageously, in that only the first channel has the expansion fold running in the peripheral direction.

Expediently, the expansion fold is arranged in the longitudinal section. Consequently, in an advantageous configuration, the expansion fold can extend over the entire periphery of the first channel. The movements of the channels are decoupled from each other to a limited extent in the longitudinal section, such that a change in length of the second channel is influenced only slightly by the first channel, and the mobility provided by the expansion fold is not limited by the first channel.

Advantageously, the distance between the peripheral walls, measured in a direction parallel to a connecting surface of the engine connecting flange, starting from a middle of the expansion fold, is at least 5% of a height of the engine connecting flange. As a result, the elasticity of the connecting support can be of sufficient magnitude.

In an embodiment, a first wall thickness of the first channel in a first region of the expansion fold is less than a second wall thickness of the first channel in a second region of the first channel that is adjacent to the expansion fold. A large degree of elasticity of the expansion fold, and thus of the connecting support, can thereby be achieved. In particular, at low temperature the high degree of elasticity of the expansion fold in the region of the first wall thickness enables the connecting support to yield rapidly in the case of jerky movements in the region of the first wall thickness, and to heat up rapidly in this region.

Expediently, the expansion fold is arranged closer to the engine side than to the air filter side.

Advantageously, the expansion fold can extend fully around the first channel.

In particular, the expansion fold projects into the through opening.

In an embodiment, the second channel has a third region, having a third wall thickness, and a fourth region, having a fourth wall thickness. The third wall thickness is advantageously less than the fourth wall thickness. As a result, the second channel, and thus also the connecting support, can have a large degree of elasticity. In particular, at low ambient temperature the high degree of elasticity of the second channel in the region of the third wall thickness enables the connecting support to yield rapidly in the case of jerky movements in the region of the third wall thickness, and to heat up rapidly in this region.

Expediently, the third region of the second channel is arranged in the longitudinal section of the connecting support, in which the first peripheral wall and the second peripheral wall are arranged at a distance from each other. As a result, the connecting support can have a high degree of elasticity, particularly in the longitudinal section.

Advantageously, the third region can be arranged closer to the engine side than to the air filter side.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
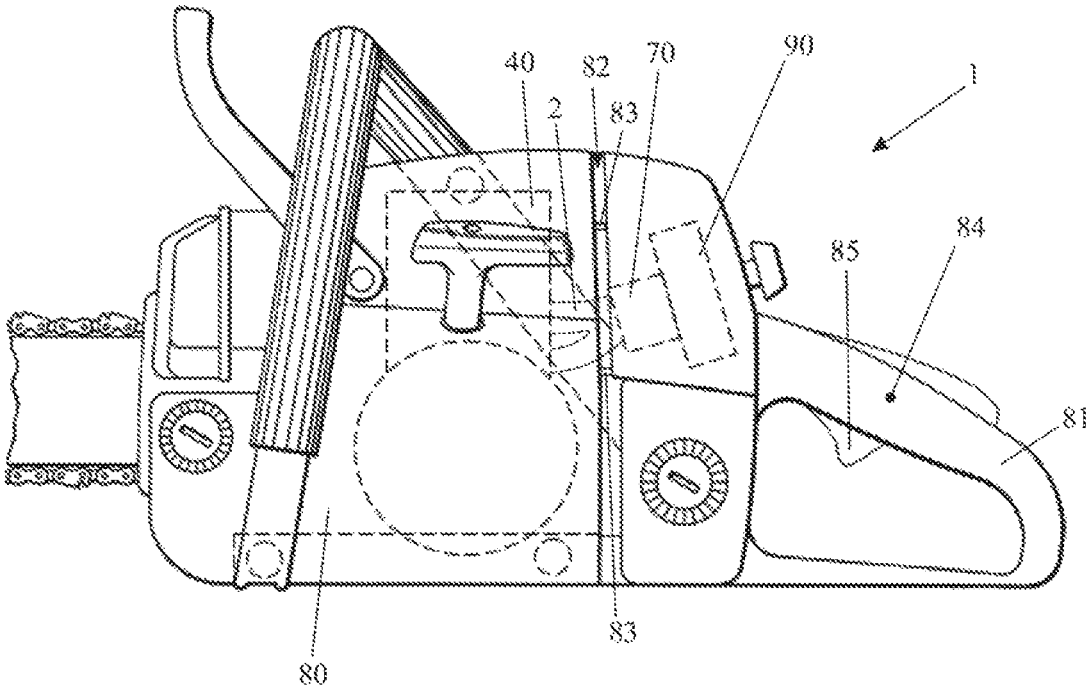
FIG. 1 is a schematic side view of a handheld work apparatus.

FIG. 1 shows a handheld work apparatus 1, in a schematic side view. In the embodiment, the handheld work apparatus 1 is a power saw. Instead of the power saw 1, other handheld work apparatus such as, for example, a cutting grinder, a hedge trimmer or a brushcutter may be provided. The handheld work apparatus 1 has a combustion engine 40 for driving a saw chain 19. The handheld work apparatus 1 has a carburetor 70 for supplying fuel/air mixture to the combustion engine 40. The carburetor 70 can advantageously be connected to the combustion engine 40 via a connecting support 2. The carburetor 70 can preferably be connected to the clean space of an air filter 90, via which combustion air is taken in during operation. The supply of fuel may be effected via a normal carburetor or via an electronically controlled carburetor.

The combustion engine 40 can advantageously be held on an engine housing 80 of the handheld work apparatus 1. For this purpose, the combustion engine 40 is fixedly connected to the engine housing 80. It may be provided that parts of the engine housing 80 form parts of the combustion engine 40, for example a crankcase of the combustion engine 40. The handheld work apparatus 1 has a handle housing 81, which has a handle 84. Arranged on the handle 84 there is throttle lever 85, for actuating the combustion engine 40. The air filter 90 is held on the handle housing 81. The carburetor 70 can advantageously be held on the handle housing 81. The handle housing 81 is separated from the engine housing 80 by a vibration gap 82. The vibration gap 82 is bridged by a plurality of anti-vibration elements 83. The anti-vibration elements 83 connect the engine housing 80 to the handle housing 81 in a vibration-damping manner. Owing to the anti-vibration elements 83, during operation the handle housing 81 can execute relative movements with respect to the engine housing 80.

The connecting support 2 and the carburetor 70 are arranged between the air filter 90 and the combustion engine 40. The connecting support 2 can advantageously be arranged between the carburetor 70 and the combustion engine 40. It may also be provided that the connecting support is arranged directly between an air filter and a combustion engine. The connecting support 2 bridges the vibration gap 82 and permits a relative movement between the air filter 90 and the combustion engine 40.

Figure 2:
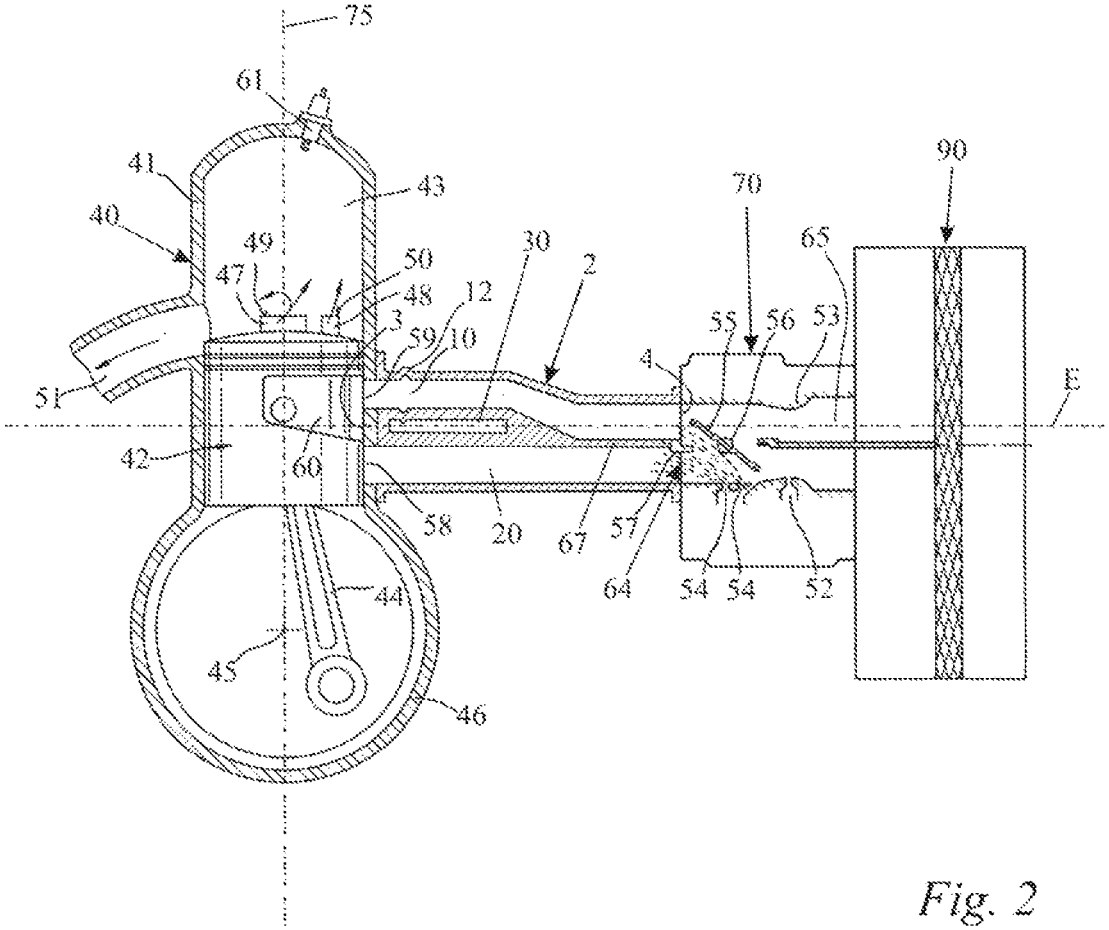
FIG. 2 is a schematic representation of a section through a combustion engine, an air filter, a carburetor and a connecting support of the work apparatus from FIG. 1.

As represented in FIG. 2, the combustion engine 40 has a cylinder 41, realized in which there is a combustion chamber 43. The cylinder has a longitudinal cylinder axis 75. The combustion chamber 43 is delimited by a piston 42 mounted in a reciprocating manner in the cylinder 41. Via a connecting rod 44, the piston 42 drives a crank shaft 45, which is rotatably mounted in a crankcase 46.

Ending in the crankcase 46 is a mixture intake 58, which, in the embodiment shown, is controlled by the piston 42. In the embodiment the mixture intake 58 is arranged on the cylinder bore, and is opened and closed by the piston skirt of the piston 42.

In the region of the lower dead point of the piston 42, shown in FIG. 2, the crankcase 46 is connected to the combustion chamber 43 via two transfer channels 47 and two transfer channels 48. In FIG. 2, respectively one transfer channel 47 and one transfer channel 48 are arranged in front of the plane of the drawing, and are therefore not shown. The transfer channels 47 and 48 end, with transfer windows 49 and 50, in the combustion chamber 43. Leading from the combustion chamber 43 is a discharge opening 51, which is slot-controlled by the piston 42, and which is open in the lower dead point position of the piston 42 shown in FIG. 2.

The combustion engine 40 is connected to the air filter 90 via an intake channel 64. During operation, the combustion engine 40 takes in air via the intake channel 64. A section 65 of the intake channel 64 is realized in the carburetor 70. The carburetor 70 has a section in which fuel is supplied, via a main fuel opening 52 and secondary fuel openings 54, to the combustion air taken in. The main fuel opening 52 is arranged in the region of a venturi 53. The secondary fuel openings 54 are arranged downstream of the main fuel opening 52. There is an adjustable throttle element arranged in the carburetor 70. In the embodiment, the throttle element is a throttle flap 55, which is pivotably mounted with a throttle shaft 56.

In the embodiment, the combustion engine 40 is realized as a stratified-scavenging two-stroke engine. For the purpose of supplying stratified scavenging air, the intake channel 64 is divided, downstream of the throttle flap 55, into a mixture channel and an air channel. In the carburetor 70, the division into a mixture channel and an air channel is effected by a partition wall section 57, which extends parallel to the flow direction in the intake channel 64. In the connecting support 2, the air channel runs in a first channel 10 of the connecting support 2. The mixture channel runs, in the connecting support 2, in a second channel 20 of the connecting support 2. The first channel 10 ends, with an air intake 59, at the cylinder 41. The second channel 20 ends, with the mixture intake 58, in the region of the cylinder 41, in the interior of the crankcase 46. In the region of the upper dead point of the piston 42, the air intake 59 is connected to the transfer windows 49 and 50 of the transfer channels 47 and 48 via piston pockets 60 realized in the circumferential surface of the piston 42.

When the combustion engine 40 is in operation, upon the upward movement of the piston 42 fuel/air mixture is taken into the crankcase 46 via the second channel 20. In the region of the upper dead point of the piston 42, stratified scavenging air is pre-stored in the transfer channels 47 and 48. For this purpose, via the piston pockets 60, largely fuel-free air is taken in out of the first channel 10, via the transfer windows 49 and 50, into the transfer channels 47 and 48. Upon the following downward movement of the piston 42, the fuel/air mixture is compressed in the crankcase 46. As soon as the transfer windows 49 and 50 open toward the combustion chamber 43, firstly the pre-stored, largely fuel-free air, and then fuel/air mixture, flows through the transfer channels 47 and 48 into the combustion chamber 43. Upon the subsequent upward movement of the piston 42, the mixture is compressed in the combustion chamber 43 and, in the region of the upper dead point of the piston 42, ignited by a spark plug 61. Advantageously, the spark plug 61 can project into the combustion chamber 43. As a result of the combustion, the piston 42 is accelerated toward the crankcase 46. As soon as the discharge opening 51 is opened by the piston 42, the exhaust gases can escape from the combustion chamber 43. Then, again, firstly, largely fuel-free air, which separates the exhaust gases, escaping from the discharge opening 51, from the following fresh mixture, flows through the transfer channels 47 and 48 into the combustion chamber 43.

Figure 3:
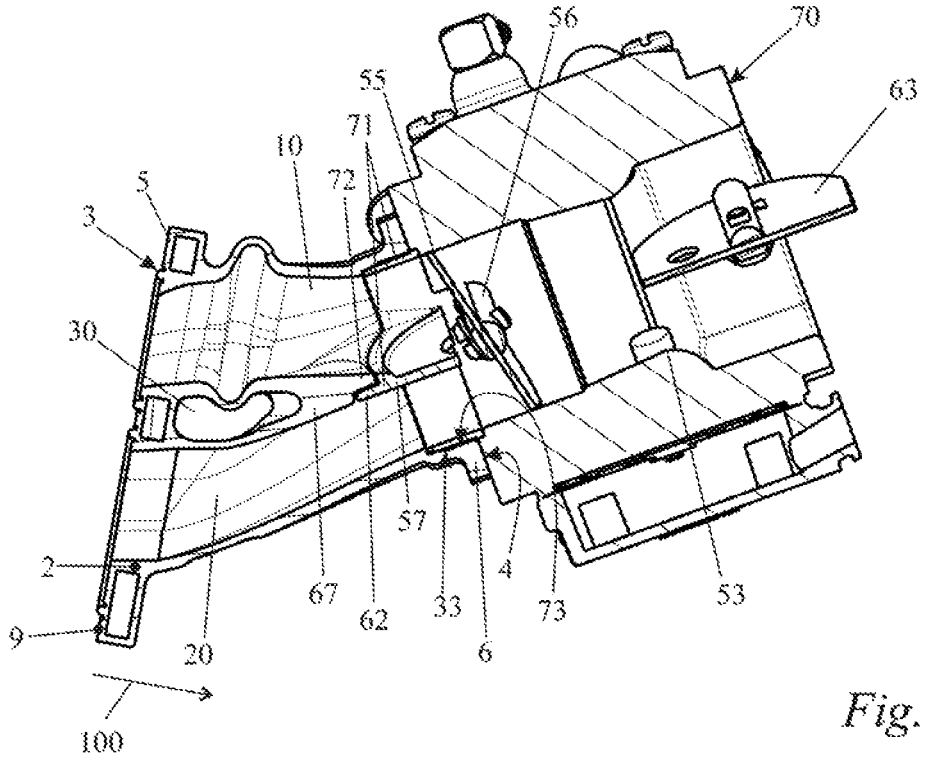
FIG. 3 is a section through the carburetor and the connecting support from FIG. 2.

FIG. 3 shows a section through the connecting support 2 and the carburetor 70, along the longitudinal direction of the intake channel 64 represented in FIG. 2. The connecting support 2 has a connecting flange 6 on its air filter side. The connecting support 2 is connected to the carburetor 70 via the connecting flange 6. In this case, in the embodiment, arranged between the carburetor 70 and the connecting support 2 there is an intermediate ring 71, in which a section of the intake channel 64 is realized. The intermediate ring 71 includes the partition wall section 57. The partition wall section 57 can advantageously project into the connecting support 2. The partition wall section 57 can preferably project through the connecting flange 6 of the connecting support 2. The intermediate ring 71 is inserted in a circumferential depression 73 on the connecting support 2. The intermediate ring 71 is thereby centered in the connecting support 2. Advantageously, the partition wall section 57 of the intermediate ring 71 is precisely positioned as a result of the intermediate ring 71 being in contact with the circumferential depression 73 of the connecting support 2.

The connecting support 2 has a partition wall 67, which separates the first channel 10 and the second channel 20 of the connecting support 2 from each other. The partition wall 67 of the connecting support 2 is advantageously in contact with the partition wall section 57 of the intermediate ring 71. The partition wall 67 continues the partition wall section 57. The intermediate ring 71 is made from dimensionally stable material, advantageously from metal or dimensionally stable plastic. The partition wall section 57 stabilizes and holds the partition wall 67, preferably in the case of relative movements between the engine housing 81 and the handle housing 80. For the purpose of connecting the air channel sections of the carburetor 70 and of the connecting support 2, and for the purpose of connecting the mixture channel sections of the carburetor 70 and of the connecting support 2, the partition wall 67 of the connecting support 2 has a contact projection 72. The partition wall section 57 of the intermediate ring 71 can advantageously have a contact projection 62. The contact projection 72 of the partition wall 67 of the connecting support 2 and the contact projection 62 of the partition wall section 57 of the intermediate ring 71 are in contact with each other in an overlapping manner in the longitudinal direction 100. Bending of the elastic contact projection 72 upon movements during operation can thereby be avoided.

If the second side 4 of the connecting support 2 is connected to the carburetor 70 in that the connecting flange 6 is connected to the carburetor 70, a connection of the air channel sections of the carburetor 70 and of the connecting support 2, and of the mixture channel sections of the carburetor 70 and of the connecting support 2, can also advantageously be produced at the same time.

As shown by FIG. 3, the partition wall section 57 extends, starting from the point of contact on the partition wall 67 of the connecting support 2, contrary to the direction of flow, to close to the throttle shaft 56. When the throttle flap 55 is in the full throttle position, the throttle flap 55 is in contact with the partition wall section 57 of the intermediate ring 71, such that, between the throttle flap 55 and the partition wall section 57, insofar as possible no fuel/air mixture can pass from the mixture channel into the air channel. In the full throttle position, the throttle flap 55 and the partition wall section 57 lie approximately in a common plane. In the idling position, and in all positions between the idling position and the full throttle position, a gap may be realized, between the throttle flap 55 and the partition wall section 57 of the carburetor 70, through which fuel/air mixture can pass from the mixture channel into the air channel.

Downstream of the throttle flap 55 there is a choke flap 63 arranged in the carburetor 70. A further partition wall section, for separating the air channel and the mixture channel, may be provided between the throttle flap 55 and the choke flap 63.

Figure 4:
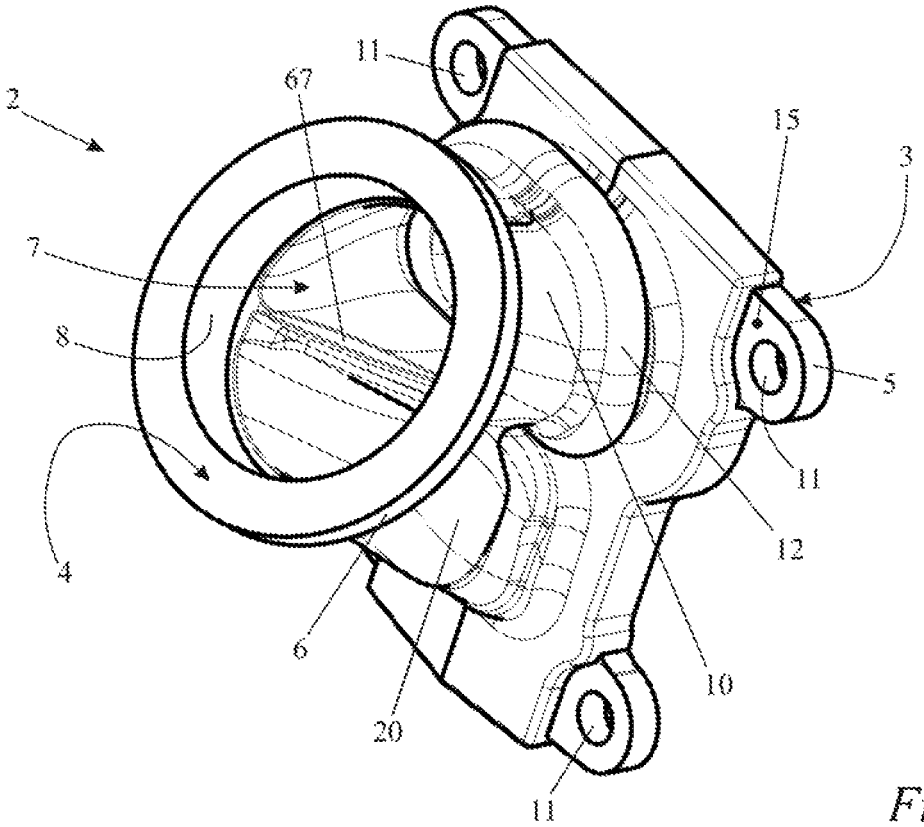
FIG. 4 is a perspective representation of the connecting support from FIG. 2.

The connecting support 2 permits a relative movement of the combustion engine 40, held on the engine housing 80, and the air filter 90, held on the handle housing 81 (FIGS. 1 and 2). Likewise, an unimpeded relative movement of the combustion engine 40 and of the carburetor 70 is possible because of the connecting support 2. The connecting support 2 is formed, at least partly, from elastic material, for example from elastomer. As represented in FIG. 4, for example, the connecting support 2 is preferably realized as a single piece. The connecting support 2 has a first side 3, which is provided for connection to the combustion engine 40. The first side 3 is also referred to as the engine side. The connecting support 2 has a second side 4, for connecting the connecting support 2 to a component of the handheld work apparatus 1. In the embodiment, the component to which the connecting support 2 is connected is the carburetor 70. It may also be provided, however, that the connecting support is directly connected to the air filter. The second side 4 is also referred to as the air filter side. The air filter side of the connecting support 2 faces away from the engine side of the connecting support 2.

Figure 5:
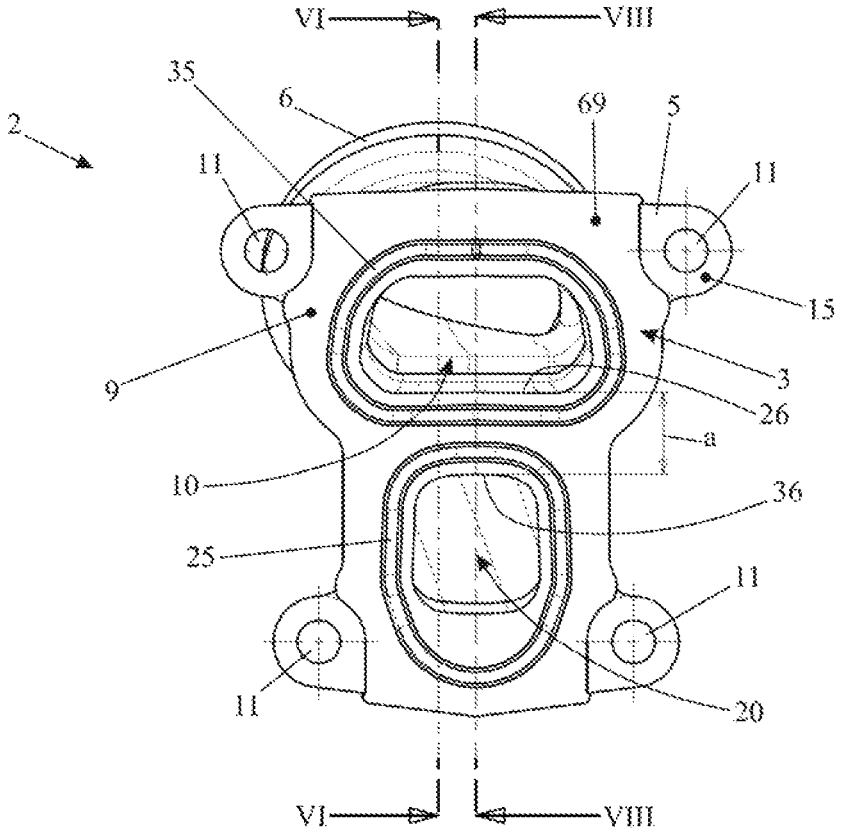
FIG. 5 is a side view of the connecting support from FIG. 2, in the direction of the arrow V in FIG. 6.

On its first side 3, the connecting support 2 has an engine connecting flange 5, for connection to the combustion engine 40. As represented in FIG. 5, the first channel 10 and the second channel 20 of the connecting support 2 end at the engine connecting flange 5. It can be seen from FIGS. 5 and 6 that the engine connecting flange 5 has a largely planar connecting surface 9 for contact on the combustion engine 40. As represented in FIG. 3, a longitudinal direction 100 runs, starting from the first side 3, perpendicularly in relation to the connecting surface 9 of the engine connecting flange 5, in the direction of the second side 4.

Figure 6:
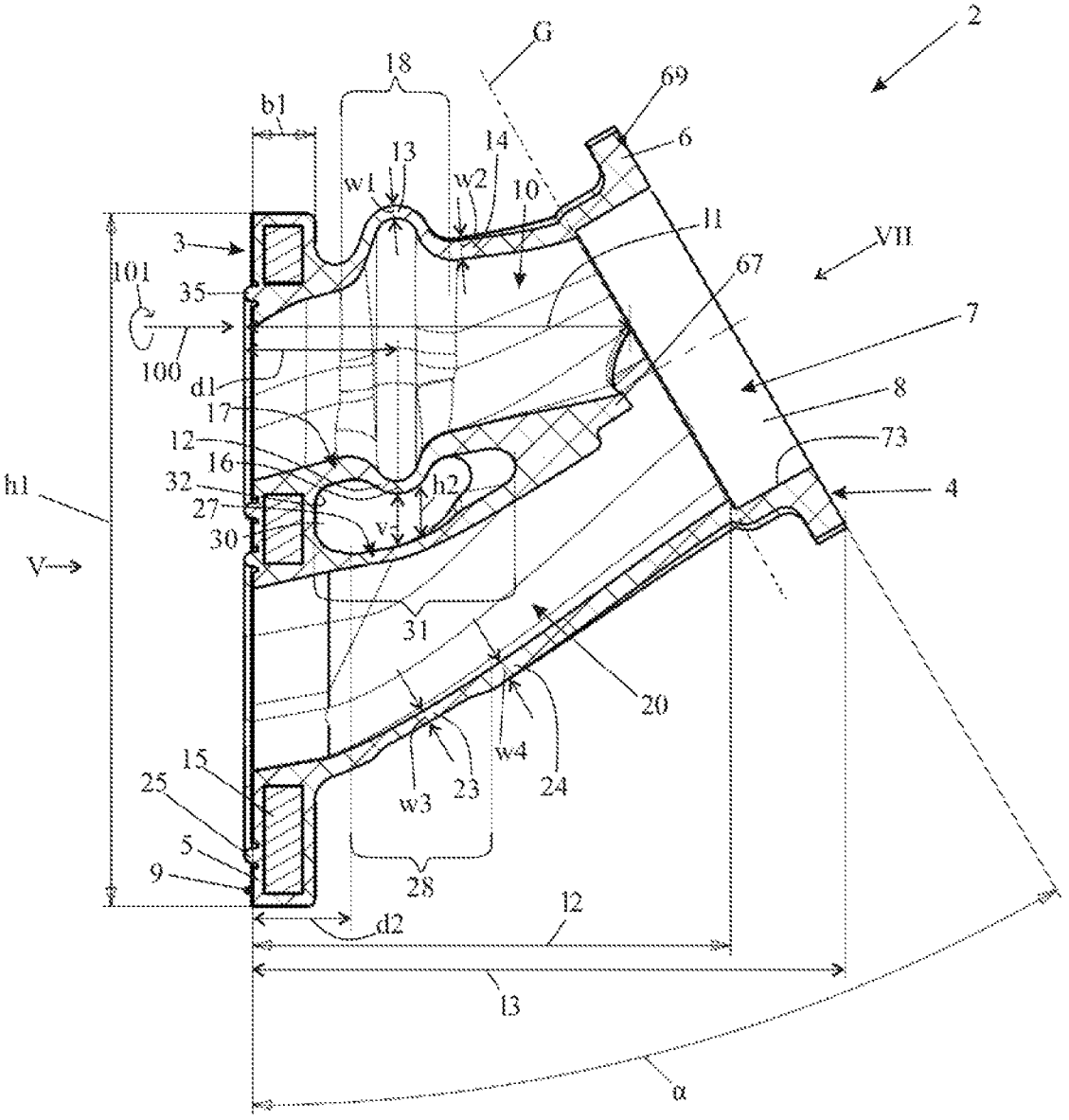
FIG. 6 is a section through the connecting support from FIG. 2, along the section line VI-VI in FIG. 5.

Circumferential sealing lips 25 and 35 protrude from the planar connecting surface 9 shown in FIGS. 5 and 6. The sealing lip 35 is provided to seal the connection between the combustion engine 40 and the first channel 10. The sealing lip 25 is provided to seal the connection between the combustion engine 40 and the second channel 20. In this planar connecting surface 9 of the engine connecting flange 5, the first channel 10 and the second channel 20 are arranged over one another, in the direction of the longitudinal cylinder axis 75 represented in FIG. 2. As represented in FIG. 5, on the first side 3 of the connecting support 2 the first channel 10 ends in a first outlet 26 of the connecting support 2. On the second side 4 of the connecting support 2, the second channel 20 ends in a second outlet 36 of the connecting support 2. The first outlet 26 and the second outlet 36 preferably are at a distance a from each other in the direction of the longitudinal cylinder axis 75.

The connecting surface 9 can preferably have four attachment openings 11. Via screws the connecting support 2 can be fastened, through the attachment openings 11, to the combustion engine 40. To connect the first channel 10 and the second channel 20 to the combustion engine 40, it is then only necessary for the engine connecting flange 5 to be connected to the combustion engine 40. It is not necessary to connect each channel 10, 20 individually to the combustion engine 40.

As represented in FIG. 6, the engine connecting flange 5 has a width b1, measured in the longitudinal direction 100. The engine connecting flange 5 may advantageously include a reinforcing core 15. The reinforcing core 15 may be made from dimensionally stable material, for example from metal. In the embodiment, the reinforcing core 15 is surrounded by an elastic material. The elastic material may be, for example, rubber or an elastic plastic. In the longitudinal direction 100 the reinforcing core 15 extends, at least between the first channel 10 and the second channel 20, over at least two thirds of the width b1 of the engine connecting flange 5. As shown by FIG. 6, the reinforcing core 15 may be realized in the form of a plate. In the embodiment, the outlets 26, 36 (FIG. 5) of the first channel 10 and of the second channel 20 extend fully through the plate-type reinforcing core 15. FIGS. 2 and 5, when viewed jointly, show that the first outlet 26 of the first channel 10 is provided for connection to the air intake 59 in the wall of the cylinder 41. The second outlet 36 of the second channel 20 is provided for connection to the mixture intake 58 in the wall of the cylinder 41.

Figure 7:
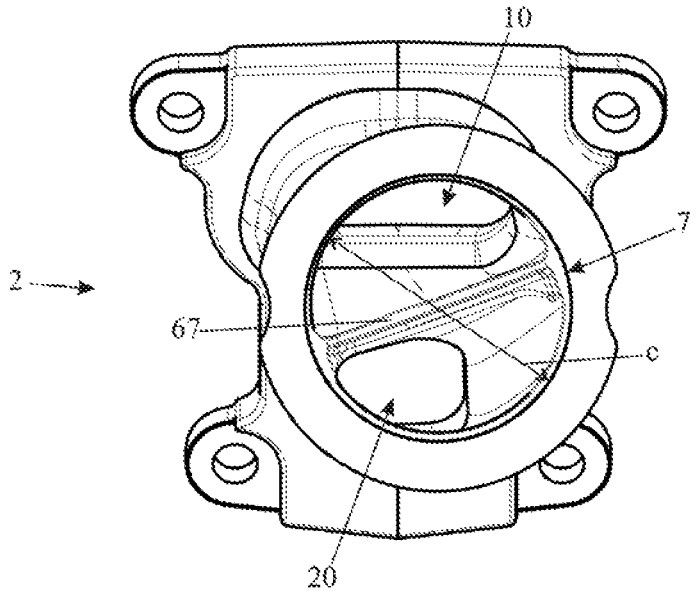
FIG. 7 is a side view of the connecting support from FIG. 2, in the direction of the arrow VII in FIG. 6; and, FIG. 8 is a section through the connecting support from FIG. 2, along the section line VIII-VIII in FIG. 5.

As represented in FIG. 4, on the second side 4 the first channel 10 and the second channel 20 end at the common connecting flange 6, at a common outlet opening 7. An outer contour 8 of the outlet opening 7 can preferably be circular. As represented in FIG. 7, the circular outer contour 8 of the outlet opening 7 has a diameter c. To connect the first channel 10 and the second channel 20, on the second side 4 of the connecting support 2, to the carburetor 70, it is necessary only for the connecting flange 6 to be connected to the carburetor 70. It is not necessary to connect each channel 10, 20 individually to the carburetor 70.

To seal the connection of the first channel 10 and the carburetor 70, and the connection of the second channel 20 and the carburetor 70, it is necessary only for a single connection point, between the connecting flange 6 of the connecting support 2, on the second side 4, and the carburetor 70, to be sealed.

Starting from the common outlet opening 7 on the second side 4 of the connecting support 2, the first channel 10 and the second channel 20 extend as far as the engine side of the connecting support 2. As represented in FIG. 6, the first channel 10 has a first length 11, measured in the longitudinal direction 100 from the connecting surface 9 as far as the common outlet opening 7 of the connecting flange 6 on the second side 4. The second channel 20 has a second length 12, measured in the longitudinal direction 100 from the connecting surface 9 as far as the common outlet opening 7 of the connecting flange 6 on the second side 4. The common outlet opening 7 is delimited by a plane G, which separates the channels 10, 20 from the circumferential depression 73 for the intermediate ring 71. The lengths 11 and 12 extend from the connecting surface 9 as far as the plane G. The second length 12 is greater than the first length 11.

The connecting flange 6, on the second side 4 of the connecting support 2, has a contact surface 69 for contact on a component of the handheld work apparatus 1. In the embodiment, the connecting support 2 is in contact with the contact surface 69 on the carburetor 70, as represented in FIG. 3. FIG. 6 shows that the connecting surface 9, on the first side 3, and the connecting surface 69, on the second side 4, are oriented at an angle α of from 10° to 80°, in particular from 15° to 45°, preferably from 25° to 35°, in relation to each other. The angle α opens in the direction from the first channel 10 to the second channel 20.

As represented in particular in FIG. 6, the first channel 10 has a first peripheral wall 17. The second channel 20 has a second peripheral wall 27. In the region between the first channel 10 and the second channel 20, the first peripheral wall 17 of the first channel 10 and the second peripheral wall 27 of the second channel 20 jointly form the partition wall 67 of the connecting support 2. In a longitudinal section 31 of the connecting support 2, the first peripheral wall 17 of the first channel 10 and the second peripheral wall 27 of the second channel 20 are arranged at a distance v from each other. It may be provided that the first peripheral wall 17 and the second peripheral wall 27 are connected, in the longitudinal section 31 of the connecting support 2, by a thin, membranous skin. In the embodiment, advantageously realized between the first peripheral wall 17 and the second peripheral wall 27, in the longitudinal section 31, there is a through opening 30, which is also shown in FIGS. 2 and 3. The through opening 30 extends between the first channel 10 and the second channel 20, parallel to the connecting surface 9 of the engine connecting flange 5. The through opening 30 extends in a plane E, represented in FIG. 2, which is perpendicular to the longitudinal cylinder axis 75. The through opening 30 has an inner peripheral wall 32. The through opening 30 extends fully through the connecting support 2, in a direction perpendicular to the longitudinal direction 100.

As shown in FIG. 6, the connecting support 2 has a total length 13, measured in the longitudinal direction 100. The longitudinal section 31 advantageously extends over at least one quarter, in particular at least 30%, of the total length 13. The longitudinal section 31 advantageously extends over at least 30% of the second length 12 of the second channel 20. In the embodiment, the longitudinal section 31 extends as far as the engine connecting flange 5. In the region of the engine connecting flange 5, the partition wall 67 of the connecting support 2 is formed both by the first peripheral wall 17 of the first channel 10 and by the second peripheral wall 27 of the second channel 20. Likewise, the partition wall 67 of the connecting support 2, in the region of the outlet opening 7, is formed both by the first peripheral wall 17 and by the second peripheral wall 27.

The engine connecting flange 5 has a height h1, measured parallel to its connecting surface 9 in the direction from the first channel 10 to the second channel 20. A height h2, measured in the middle with respect to the longitudinal extent of the longitudinal section 31 in the direction of the height h1 of the engine connecting flange 5, can preferably be at least 3%, in particular 5%, of the height h1 of the engine connecting flange 5.

As represented in FIG. 6, the first channel 10 has an expansion fold 12 running in the peripheral direction 101 of the first channel 10. The peripheral direction 101 extends around the longitudinal direction 100. By expansion of the expansion fold 12, it is possible for the length 11 of the first channel 10 to be increased. In the region of the expansion fold 12, the first channel 10 has a greater diameter than in a region outside of the expansion fold 12. A first wall thickness w1 of the first channel 10 in a first region 13 of the expansion fold 12 is advantageously less than a second wall thickness w2 of the first channel 10 in a second region 14 of the first channel 10 that is adjacent to the expansion fold 12 in the longitudinal direction 100. The expansion fold 12 may preferably be arranged in the longitudinal section 31. The expansion fold 12 extends fully around the first channel 10. The expansion fold 12 advantageously extends into the through opening 30. Of the two channels 10, 20, only the first channel 10 has an expansion fold 12 running in the peripheral direction 101. The second channel 20 advantageously has no expansion folds.

The expansion fold 12 extends, in the longitudinal direction 100, over a first extension region 18. In the first extension region 18, the first peripheral wall 17 is turned outward to form the expansion fold 12. In the embodiment according to FIG. 6, the beginning and end of the first extension region 18 are indicated by a deviation from the course of the first peripheral wall 17, in the longitudinal direction 100. At the beginning and end of the first extension region 18, the first peripheral wall 17 is curved toward the channel outer side. Preferably, in the first extension region 18, starting from the start of the first extension region 18, the wall thickness of the first peripheral wall 17 decreases to a middle 16 of the expansion fold 12 and, farther on, increases again from the middle 16 of the expansion fold 12 toward the end of the first extension region 18. The middle 16 of the expansion fold 12 advantageously has the least wall thickness of the first peripheral wall 17, namely, the first wall thickness w1 of the first region 13. The first region 13 of the expansion fold 12 is arranged in the first extension region 18 of the expansion fold 12. The second region 14 of the first channel 10 is arranged outside of the first extension region 18 of the expansion fold 12. A distance v, between the first peripheral wall 17 of the first channel 10 and the second peripheral wall 27 of the second channel 20, measured in a direction parallel to the connecting surface 9 of the engine connecting flange 5, starting from the middle 16 of the expansion fold 12, is advantageously at least 5% of the height h1 of the engine connecting flange 5.

The longitudinal section 31 may be arranged closer to the first side 3 than to the second side 4, with respect to the longitudinal direction 100. The expansion fold 12 is advantageously arranged closer to the first side 3 than to the second side 4, with respect to the longitudinal direction 100. The middle 16 of the expansion fold 12 has a first greatest distance d1 from the connecting surface 9 of the engine connecting flange 5, measured in the longitudinal direction 100. The first greatest distance d1 is advantageously less than 50%, in particular less than 45%, of the first length 11 of the first channel 10.

The second channel 20 may have a third region 23, having a third wall thickness w3. The second channel 20 may have a fourth region, having a fourth wall thickness w4. The third wall thickness w3 is advantageously less than the fourth wall thickness w4. It may also be provided, however, that the wall thickness in the third region and in the fourth region are equal. In this case, the wall thickness in the third region is not reduced in comparison with the wall thickness in the adjacent fourth region. The third region 23 of the second channel 20 is arranged in the longitudinal section 31, with respect to the longitudinal direction 100. The third region 23 of the second channel 20 preferably extends, in the longitudinal direction 100, over a second extension region 28. The end and the start of the second extension region, with respect to the longitudinal direction 100, are indicated by a deviation of the wall thickness from the fourth wall thickness w4. The third region 23 preferably extends around the second channel 20.

The third region 23 can advantageously be arranged closer to the first side 3 than to the second side 4. A second distance d2, measured in the longitudinal direction, between the connecting surface 9 of the engine connecting flange 5 and the third region 23 of the second channel 20 is advantageously less than one third, in particular less than one quarter, of the second length 12 of the second channel 20.

Figure 8:
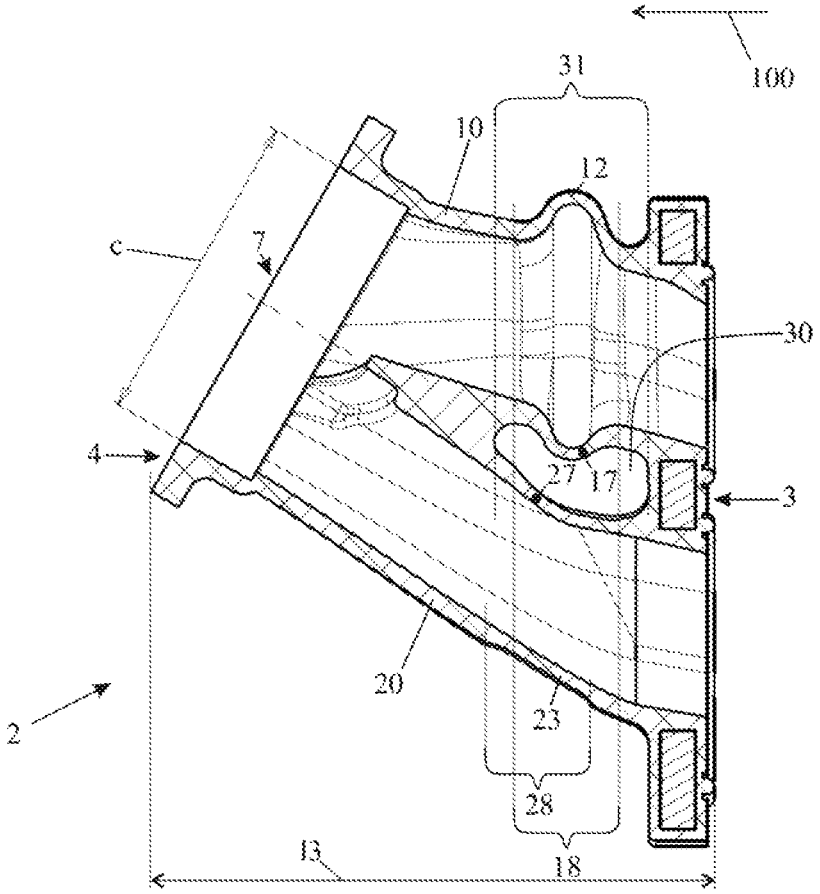

As represented in FIG. 8, the first extension region 18 of the expansion fold 12 of the first channel 10 and the second extension region 28 of the third region 23 of the second channel 20 can preferably overlap in the longitudinal direction 100. In the embodiment, the first extension region 18 and the second extension region 28 overlap, in the longitudinal direction 100, over a distance of at least two thirds of the first extension region 18. The second extension region 28 is at a greater distance than the first extension region 18 from the connecting surface 9 of the engine connecting flange 5.

It is understood that the foregoing description is that of the preferred embodiments of the invention and that various changes and modifications may be made thereto without departing from the spirit and scope of the invention as defined in the appended claims.

What is claimed is:

1. An elastic connecting support for arrangement between a combustion engine and an air filter of a handheld work apparatus, the elastic connecting support comprising:
- a first channel for largely fuel-free air;
- a second channel fora fuel/air mixture;
- the elastic connecting support being realized as a single piece and having a first side and a second side;
- an engine connecting flange disposed at said first side for connection to the combustion engine;
- said first channel and said second channel ending at said engine connecting flange;
- said first channel having a first peripheral wall;
- said second channel having a second peripheral wall;
- said first peripheral wall and said second peripheral wall being arranged at a distance (v, h2) in relation to each other in a longitudinal section of the elastic connecting support;
- said first channel and said second channel extending from said first side to said second side of the elastic connecting support;
- a common connecting flange disposed at said second side;
- said first channel and said second channel ending at said common connecting flange; and,
- wherein a through opening is defined between said first peripheral wall and said second peripheral wall in said longitudinal section.

2. The elastic connecting support of claim 1, wherein said longitudinal section extends as far as said engine connecting flange.

3. The elastic connecting support of claim 1, wherein said first channel has an expansion fold running in a peripheral direction of said first channel.

4. An elastic connecting support for arrangement between a combustion engine and an air filter of a handheld work apparatus, the elastic connecting support comprising:
- a first channel for largely fuel-free air;
- a second channel fora fuel/air mixture;
- the elastic connecting support being realized as a single piece and having a first side and a second side;
- an engine connecting flange disposed at said first side for connection to the combustion engine;
- said first channel and said second channel ending at said engine connecting flange;
- said first channel having a first peripheral wall;
- said second channel having a second peripheral wall;
- said first peripheral wall and said second peripheral wall being arranged at a distance (v, h2) in relation to each other in a longitudinal section of the elastic connecting support;
- said first channel and said second channel extending from said first side to said second side of the elastic connecting support;
- a common connecting flange disposed at said second side;
- said first channel and said second channel ending at said common connecting flange; and,
- said first channel having an expansion fold running in a peripheral direction of said first channel; and,
- wherein only said first channel has said expansion fold running in the peripheral direction.

5. The elastic connecting support of claim 3, wherein said expansion fold is arranged in said longitudinal section.

6. The elastic connecting support of claim 3, wherein:
- said engine connecting flange has a connecting surface and a height (h1); and,
- said distance (v) between said first peripheral wall and said second peripheral wall measured in a direction parallel to said connecting surface of said engine connecting flange, starting from a middle of said expansion fold is at least 5% of said height (h1).

7. The elastic connecting support of claim 3, wherein:
- said first channel has a first wall thickness (w1) in a first region of said expansion fold;
- said first channel has a second wall thickness (w2) in a second region adjacent to said expansion fold; and,
- said first wall thickness (w1) is less than said second wall thickness (w2).

8. The elastic connecting support of claim 3, wherein said expansion fold is arranged closer to said first side than to said second side.

9. The elastic connecting support of claim 3, wherein said expansion fold extends fully around said first channel.

10. The elastic connecting support of claim 3, wherein:
- a through opening is defined between said first peripheral wall and said second peripheral wall in said longitudinal section; and,
- said expansion fold projects into said through opening.

11. The elastic connecting support of claim 3, wherein:
- said second channel has a third region and a fourth region;
- said third region has a third wall thickness (w3);
- said fourth region has a fourth wall thickness (w4); and,
- said third wall thickness (w3) is less than said fourth wall thickness (w4).

12. The elastic connecting support of claim 11, wherein said third region of said second channel is arranged in said longitudinal section.

13. The elastic connecting support of claim 11, wherein said third region is arranged closer to said first side than to said second side.

14. A handheld work apparatus comprising:

a combustion engine;

a carburetor;

an elastic connecting support having a first channel for largely fuel-free air and a second channel for a fuel/air mixture;

said elastic connecting support being realized as a single piece and having a first side and a second side;

said elastic connecting support having an engine connecting flange disposed at said first side for connection to the combustion engine; said first channel and said second channel ending at said engine connecting flange;

said first channel having a first peripheral wall;

said second channel having a second peripheral wall;

said first peripheral wall and said second peripheral wall being arranged at a distance (v, h2) in relation to each other in a longitudinal section of the elastic connecting support; said first channel and said second channel extending from said first side to said second side of the elastic connecting support;

said elastic connecting support having a common connecting flange disposed at said second side;

said first channel and said second channel ending at said common connecting flange;

said elastic connecting support being arranged between said combustion engine and said carburetor; and wherein a through opening is defined between said first peripheral wall and said second peripheral wall in said longitudinal section.

* * * * *